US006119461A

United States Patent [19]

Stevick et al.

[11] Patent Number: 6,119,461

[45] Date of Patent: Sep. 19, 2000

[54] THERMAL-ELECTRIC CONTAINER

[76] Inventors: Glen Stevick, 1636 Walnut St.; Harvey Sherback, 1525 Shattuck Ave., Apt. C, both of Berkeley, Calif. 94709

[21] Appl. No.: 09/224,970

[22] Filed: Jan. 4, 1999

Related U.S. Application Data

[60] Provisional application No. 60/070,420, Jan. 5, 1998.

[51] Int. Cl.[7] ..... F25B 21/02

[52] U.S. Cl. ..... 62/3.64; 62/3.3; 62/457.9

[58] Field of Search ..... 62/3.3, 3.64, 457.9

[56] References Cited

U.S. PATENT DOCUMENTS 4,311,017 1/1982 Reed et al. ..... 62/3
4,993,229 2/1991 Baus et al. ..... 62/3.64
5,042,258 8/1991 Sundhar ..... 62/457.9 X
5,603,220 2/1997 Seaman ..... 62/457.9 X
5,782,094 7/1998 Freeman ..... 62/3.6
5,842,353 12/1998 Lin ..... 62/3.3 X

*Primary Examiner*—William Doerrler
*Assistant Examiner*—Chen-Wen Jiang
*Attorney, Agent, or Firm*—Lyon & Lyon LLP

[57] ABSTRACT

A metallic insulated container (e.g. vacuum) such as a cup, mug, tumbler, bottle, coffee maker and brewing container is combined with a solid state thermal electric generator to create a container which heats and cools food and beverages and keeps the food and beverages hot or cold.

17 Claims, 1 Drawing Sheet

THERMAL-ELECTRIC CONTAINER

RELATED APPLICATION DATA

This application is a continuing application of provisional application Ser. No. 60/070,420 filed Jan. 5, 1998.

BACKGROUND OF THE INVENTION

The field of the present invention relates to a self-heating insulated container combinations such as beverage or food container (e.g. a cup, mug, tumbler, bottle, coffee maker and brewing container) in which the container heats and cools food and beverages thereby keeping the food and beverages hot or cold.

Prior heating containers utilized internal resistance coils which produced very high temperatures and breached the vacuum separating the inner and outer shells of the container. Internal temperatures in resistance coil heaters are very high, producing damaging thermal gradients. Further, these resistance coil heaters consumed relatively high amounts of electrical power.

SUMMARY OF THE INVENTION

The present invention relates to a combination insulated (e.g. vacuum) container and solid state thermal-electric generator to create a container which heats and/or cools the beverage/food and then keeps the beverage and food hot and/or cold. The preferred container is a metallic vacuum container such as a cup, mug, tumbler, bottle, or brewing container such as a coffee maker combining the thermal insulative benefits of a vacuum container and the heating properties of a thermal-electric generator. The thermal-electric generator provides heat to the interior of the container through both resistance heating and by pumping heat from the container exterior wall to the interior wall. Cooling is provided by pumping heat from the interior wall to the exterior wall via the thermal-electric generator. This construction provides a compact heating and cooling unit that fits neatly between the inner and outer shells of the container without compromising the insulation. The thermal-electric generating unit is placed in contact with both interior and exterior metallic shells creating heat and a temperature difference via the thermal-electric process. In a preferred configuration, the thermal-electric generating device may be powered by 12 volt DC power with a connector which is automobile compatible.

DESCRIPTION OF THE PREFERRED EMBODIMENTS

The preferred embodiments of the present invention will now be described with reference to the drawings. For simplicity of description, any element numeral in one figure will represent the same element if used in any other figure.

Figure 1:
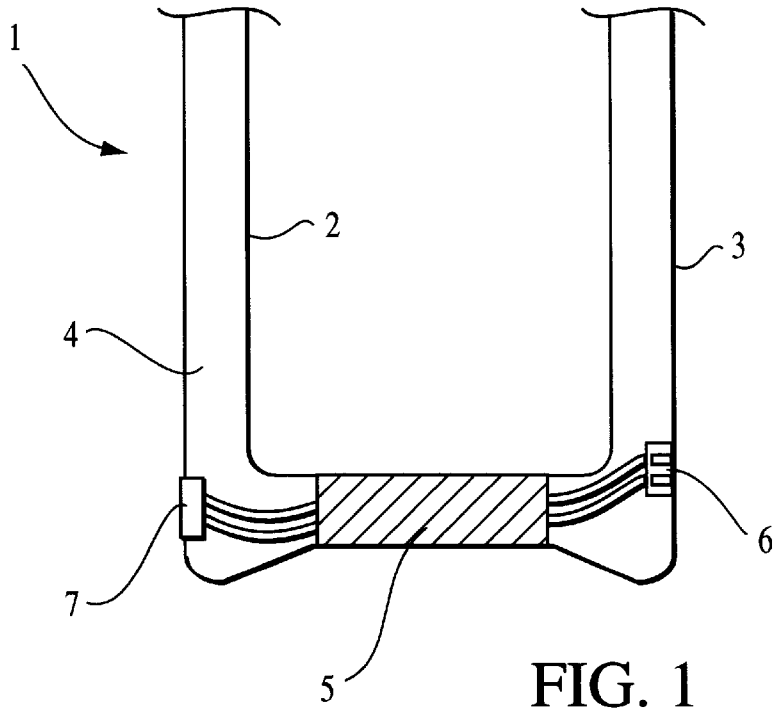
FIG. 1 is a cutaway view of a metallic thermal-electric vacuum cup employing a first embodiment of the present invention.

FIG. 1 illustrates a thermal-electric container 1 includes an interior shell 2 and an exterior shell 3 separated by an annular space or volume 4. Both the interior shell 2 and the exterior shell 3 are preferably constructed of metallic material, such as stainless steel or aluminum, having relatively high thermal conductivity. A vacuum, or alternately an air space, is maintained in the volume 4 between the interior shell 2 and exterior shell 3 to provide thermal insulation between the inner shell 2 and the outer shell 3. A thermal-electric generator or thermoelectric chip 5 is positioned between the bottom of the interior shell 2 and the bottom or base of the exterior shell 3. The thermal-electric generator 5 may be powered by an exterior plug-in connection 6 or flush contacts 7 typically used in a cradle or holding device. Preferably, the thermoelectric chip 5 is bonded to both the outer surface of the bottom of the inner wall 2 and to the inner surface of the bottom of the outer wall 3 to ensure efficient thermal connection to those surfaces.

When heating, the thermal-electric generator 5 pumps heat from the outer shell 3 to the inner shell 2. The shells 2 and 3 function as cold and hot fins, respectively, for the thermal-electric generator 5. When cooling, heat is pumped in the opposite direction, from the inner shell 2 to the outer shell 3, by reversing the voltage (plus and minus) applied to the thermal-electric generator 5.

The external shell 3 operates as a heat sink or heat source for the container system 1 enabling the thermal-electric generator 5 to operate as a heat pump for efficient heating or cooling of the contents of the container. The container 1 is a portable, hand-holdable unit such as a cup, mug, tumbler, bottle, or brewing container such as a coffee maker which combines the thermal insulative benefits of a vacuum container and the heating properties of a thermal-electric generator.

The thermal-electric generator 5 is preferably a solid state device such as disclosed in U.S. Pat. No. 5,492,570 herein incorporated by reference. The thermal-electric generator may be powered using a 12 volt supply (e.g. battery, auto-plug, or ac/dc converter) through the connector 6 on the side of the container. The electric connector 6 may be of any commonly available jack-type plug. In a preferred construction, the connection 6 is connected to a plug adapted to be compatible with an automobile cigarette lighter outlet, holding cradle or other automobile power supplies.

Figure 2:
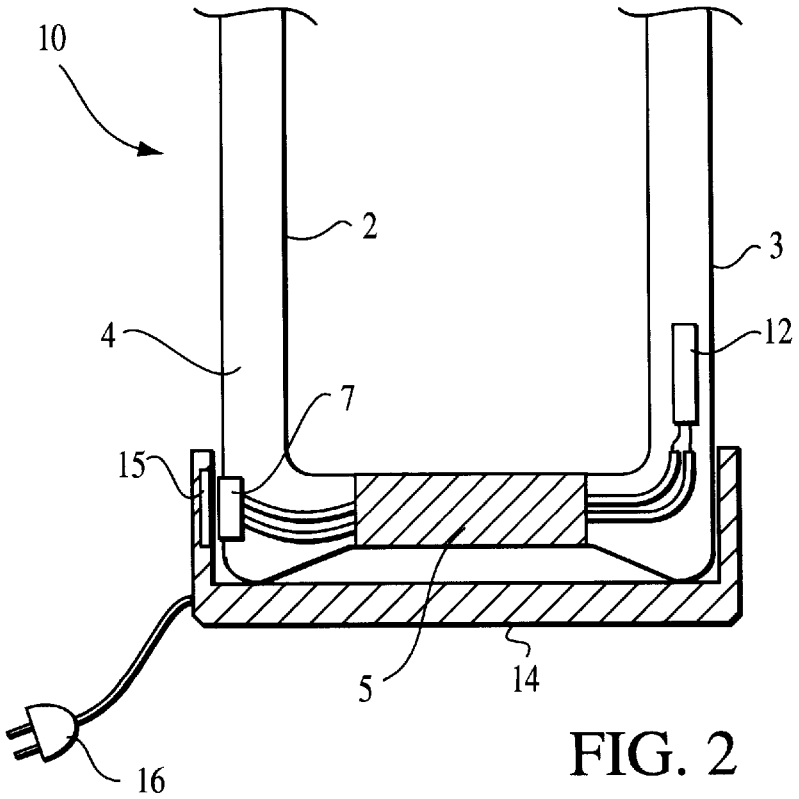
FIG. 2 is a cutaway view of a vacuum cup and holder combination according to an alternate embodiment.

FIG. 2 illustrates a container 10 according to an alternate embodiment. The container 10 is similar to the container 1 of FIG. 1, with like elements bearing the same element numerals and description of like elements not repeated. The container 10 may be inserted into a cradle 14. The cradle 14 includes contacts 15 which are arranged to engage the contacts 7 on the container 10. Power from the cradle 14 (supplied from an electrical outlet via plug 16) is supplied to the container 10 via the connection from cradle contact 15 to container contact 7.

The container 10 includes a self-contained power supply namely a battery 12, preferably rechargeable, to provide portable power to the thermal-electric generator 5. Though the battery 12 may not have sufficient power storage capacity to heat up (or cool) the contents of the container 10 from ambient (depending upon the efficiency of the heating/cooling system), if the beverage is already at the desired temperature, the battery 12 need only provide sufficient power to maintain the temperature to compensate for the heat loss through container insulation.

These objects and other objects of the invention should be discerned and appreciated from the description taken in conjunction with the figures. Thus while embodiments and applications of the present invention have been shown and described, it would be apparent to one skilled in the art that other modifications are possible without departing from the inventive concepts herein. The invention, therefore, is not to be restricted except in the spirit of the claims that follow.

What is claimed is:

1. A beverage container comprising: a metallic inner shell constructed to hold a beverage; a metallic outer shell separated from the inner shell by an annular space; a thermal-electric generator disposed between the inner shell and the outer shell; a battery positioned between the inner shell and the outer shell for supplying power to the thermal-electric generator.

2. A beverage container according to claim 1 wherein the inner shell comprises lateral sides and a bottom and wherein the thermal-electric generator comprises a thermoelectric chip bonded to the bottom of the inner shell.

3. A beverage container according to claim 1 further comprising a reversible dc power source connected to the thermal-electric generator, wherein the thermal-electric generator alternately heats or cools the inner shell depending upon the polarity of power applied by the power source.

4. A beverage container according to claim 1 wherein the container comprises a portable unit selected from the group consisting of: a cup, mug, tumbler, bottle, coffee maker and brewing container.

5. A beverage container according to claim 1 further comprising a connector for connection to an external power supply.

6. A beverage container according to claim 5 wherein the connector comprises a plug for connection via a power cord to the external power supply.

7. A beverage container according to claim 5 wherein the container is adapted for insertion into a cradle, wherein the connector comprises flush contacts for providing electrical connection upon insertion into the cradle.

8. A beverage container comprising: a metallic inner shell constructed to hold a beverage; a metallic outer shell separated from the inner shell by an annular space; a thermal-electric generator disposed between the inner shell and the outer shell; a reversible dc power source connected to the thermal-electric generator wherein the thermal-electric generator alternately heats or cools the inner shell depending upon the polarity of power applied by the power source and wherein the power source comprises a battery positioned along a side of the outer shell.

9. A beverage container according to claim 8 wherein the inner shell comprises lateral sides and a bottom and wherein the thermal-electric generator comprises a thermoelectric chip bonded to the bottom of the inner shell.

10. A beverage container according to claim 9 wherein the outer shell comprises lateral sides and a bottom, wherein the thermoelectric chip is bonded to an inner surface of bottom of the inner shell.

11. A beverage container according to claim 8 wherein the container comprises a portable unit selected from the group consisting of: a cup, mug, tumbler, bottle, coffee maker and brewing container.

12. A beverage container according to claim 1 wherein the battery comprises at least one rechargeable battery.

13. A beverage container comprising: a heat-conductive inner shell constructed to hold a beverage; a heat-conductive outer shell separated from the inner shell by an annular space; a thermal-electric generator disposed between the inner shell and the outer shell; a battery positioned between the inner shell and the outer shell for supplying power to the thermal-electric generator.

14. A container according to claim 13 wherein the battery is disposed in a lateral side of the container.

15. A container according to claim 13 further comprising a reversible dc power source comprising said battery, wherein the thermal-electric generator alternately heats or cools the inner shell depending upon the polarity of power applied by the power source.

16. A container according to claim 13 wherein the container comprises a portable unit selected from the group consisting of: a cup, mug, tumbler, bottle, coffee maker and brewing container.

17. A container according to claim 13 wherein the battery comprises at least one rechargeable battery.

* * * * *